United States Patent [19]

Nischwitz et al.

[11] 4,284,410

[45] Aug. 18, 1981

[54] PROCESS FOR THE PRETREATMENT OF CELLULOSE FIBERS TO BE PRINTED ACCORDING TO THE THERMOTRANSFER PRINTING METHOD

[75] Inventors: Ehrenfried Nischwitz, Schmitten; Walter Dürsch, Königstein, both of Fed. Rep. of Germany

[73] Assignee: Hoechst Aktiengesellschaft, Fed. Rep. of Germany

[21] Appl. No.: 76,591

[22] Filed: Sep. 18, 1979

[30] Foreign Application Priority Data

Sep. 22, 1978 [DE] Fed. Rep. of Germany ..... 2841239

[51] Int. Cl.[3] ..... D06P 1/16

[52] U.S. Cl. ..... 8/471; 8/582; 8/584; 8/597; 8/602; 8/918

[58] Field of Search ..... 8/2.5 A, 471, 582, 584, 8/597, 918, 602

[56] References Cited

U.S. PATENT DOCUMENTS

| | | | |
|---|---|---|---|
| 3,707,346 | 12/1972 | Markert et al. | 8/2.5 |
| 4,063,879 | 12/1977 | Faulhaber et al. | 8/2.5 A |
| 4,072,462 | 2/1978 | Vellins et al. | 8/2.5 A |
| 4,088,440 | 5/1978 | Leimbacher et al. | 8/2.5 A |
| 4,093,415 | 6/1978 | Defago et al. | 8/2.5 A |
| 4,167,392 | 9/1979 | Defago | 8/2.5 A |

FOREIGN PATENT DOCUMENTS

| | | |
|---|---|---|
| 2436783 | 2/1975 | Fed. Rep. of Germany . |
| 2806049 | 8/1979 | Fed. Rep. of Germany . |
| 1403119 | 8/1975 | United Kingdom . |
| 1463682 | 2/1977 | United Kingdom . |

*Primary Examiner*—A. Lionel Clingman
*Attorney, Agent, or Firm*—Connolly and Hutz

[57] ABSTRACT

A process for the pretreatment of textile material consisting entirely or partially of cellulose fibers and which is to be printed according to the thermotransfer process, which comprises impregnating the textile material with a solution or dispersion containing (a) a compound of the formula I $$NH_2-CO-Y-R \quad (I)$$

wherein R stands for a group of the formulae $R_a$, $R_b$ or $R_c$ $$-CH_2-CH=CH_2 \quad (R_a)$$

$$-(CH_2-CH_2-O)_m-R_1 \quad (R_b)$$

or $$-CHR_3-CH_2-O\left[\begin{array}{c} O \\ \| \\ P \\ | \\ R_2 \end{array}-X-CHR_3-CHR_3-O\right]_n-H \quad (R_c)$$

in said formulae $R_1$ is hydrogen or $C_{1-4}$alkyl, $R_2$ is $C_{1-4}$alkyl, $R_3$ is hydrogen or methyl, n is an integer of from 1 to 6, m is an integer of from 1 to 10, X is $CH_2$ or O and Y, in case that R stands for $R_a$ or $R_b$ is an oxygen atom and in case that R stands for $R_c$ is an oxygen atom or an imino group (NH), (b) a glyoxal or melamine formaldehyde resin and (c) an acid catalyst for the condensation of these resins, and subsequently drying the textile material and subjecting it to the action of heat.

2 Claims, No Drawings

PROCESS FOR THE PRETREATMENT OF CELLULOSE FIBERS TO BE PRINTED ACCORDING TO THE THERMOTRANSFER PRINTING METHOD

It is known to print textile material according to the so-called thermotransfer printing process, wherein the dyestuff is printed at first onto an auxiliary carrier, for example paper. The printed auxiliary carrier is then contacted with the textile material to be printed under pressure and at elevated temperature, the dyestuff diffusing during this step from the carrier into the textile material. Suitable dyestuffs for this process are mainly only disperse dyes, i.e. those which are sublimable to a certain degree. Moreover said thermotransfer printing process is restricted to polyester, polyamide, polyacrylonitrile and cellulose acetate fibers, since only these materials permit a transfer of the disperse dyes without difficulty, while ensuring a sufficient fixation of the dyes onto the fiber. Cellulose fibers on the other hand do not show any affinity to disperse dyes, so that a dye-stuff transfer to cellulose is effected only to a very small extent, the dyestuff transferred is not fixed and is removed almost entirely with the first washing. In order to print textile material of cellulose fibers or of mixtures of synthetic fibers and a high portion of cellulose fibers with disperse dyes according to the thermotransfer printing process, a pretreatment of said material is required.

German Offenlegungsschriften Nos. 2,562,590; 2,418,519 and 2,453,362 disclose the pretreatment of textile material consisting partially or entirely of cellulose fibers, to be printed by the thermotransfer printing process, by pretreating it with methylolated carbamates or ethers thereof. These products serve as cross-linking agent for the cellulose and impart a slightly improved print, which, however, is not satisfactory without the use of additional swelling agents.

It has now been found that the disperse dyes common in the thermotransfer printing process can be fixed well onto cellulose fibers when treating the textile material to be printed with non-methylolated carbamates containing groups with swelling action.

The present invention, consequently, relates to a process for the pretreatment of textile material consisting entirely or partially of cellulose fibers and which is to be printed by the thermotransfer printing process, which comprises impregnating the textile material with a solution or dispersion containing (a) a compound of the formula I $$NH_2—CO—Y—R \qquad (I)$$

wherein R stands for a group of the formulae $R_a$, $R_b$ or $R_c$ $$—CH_2—CH=CH_2 \qquad (R_a)$$

$$—(CH_2—CH_2—O)_m—R_1 \qquad (R_b)$$

or $$—CHR_3—CH_2—O—\left[\begin{array}{c} O \\ \| \\ P \\ | \\ R_2 \end{array}—X—CHR_3—CHR_3—O\right]_n—H \qquad (R_c)$$

in said formulae $R_1$ is hydrogen or $C_{1-4}$alkyl, $R_2$ is $C_{1-4}$-alkyl, $R_3$ is hydrogen or methyl, n is an integer of from 1 to 6, m is an integer of from 1 to 10, X is $CH_2$ or O and Y, in case that R stands for $R_a$ or $R_b$ is an oxygen atom and in case that R stands for $R_c$ is an oxygen atom or an imino group (NH), (b) a glyoxal or melamine formaldehyde resin and (c) an acid catalyst for the condensation of these resins, and subsequently drying the textile material and submitting it to the action of heat.

When R in the formula I stands for a radical of the formula $R_b$, this formula I may be representative for hydroxiethylcarbamate, diethylene glycol carbamate and the methyl and ethyl ethers thereof. The compounds of the formula I, which contain phosphorus ($R=R_c$) and wherein X stands for an oxygen atom have been disclosed in German patent application P No. 28 06 049.3. They are obtained by reacting one mol of a compound of the formulae IIa or IIb $$NH_2COOCHR_3CH_2OH \text{ or } NH_2CONHCHR_3CH_2OH$$

IIa IIb with 1 to 6 mols of a compound of the formula III

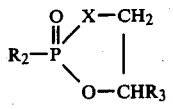

III in the presence of highly alkaline catalysts, for example alkali metals or alkali metal alcohols. When X in the radicals $R_c$ stands for a methylene group, the compounds of the formula I can be obtained in analogous manner. In this case the compounds of the formula IIa or IIb are reacted under equal conditions with a compound of the formula IIIa

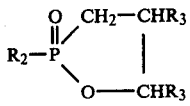

IIIa

Suitable glyoxal or melamine formaldehyde resins include all those products that are being used in textile industry, for example as resin finishing agents such as dihydroxydeimethylolethylene urea and the alkyl esters thereof, hexamethylolmelamine hexaalkyl ethers or trimethylolmelamine trialkyl ethers. These resins are fixed onto the fiber and simultaneously therewith by condensation with the aid of the acid catalysts specified sub c). These acid catalysts are salts that splitt off the acid at elevated tempratures such as magnesium chloride or ammonium chloride.

Suitable textile materials are fabrics, knitted fabrics and non-wovens which either consist entirely of cellulose fibers or represent fiber mixtures of cellulose fibers and synthetic fibers, the portion of synthetic fibers being up to 50%. It goes without saying that textiles having a lower cellulose portion or textiles made of synthetic fibers only may likewise be pretreated with the above-mentioned products, but the pretreatment is superfluous for these articles in practice, as the high portion of synthetic fibers allows of good and wash-fast thermotransfer prints owing to the high affinity of these fibers to disperse dyes. As cellulose fibers there may be mentioned mainly cotton, rayon staple and filaments, but also linen, jute, etc.

The compounds of the formula I are generally soluble in water or in a mixture of water and lower alcohols, preferably isopropanol. They are applied onto the textile material from solutions of the above type by impregnation, nip-padding, spraying or similar methods. The liquor contains of from 8 to 15 weight % of the compound of the formula I, from 3.5 to 6 weight % of the glyoxal or melamine formaldehyde resin and from 0.1 to 0.25 weight % of the acid catalyst. If desired, of from 7 to 10 weight % of a polyglycol having an average chain length (molecular weight of from 400 to 600) can be added to the liquor.

The treatment bath is applied onto the textile material in such an amount that there results a quantity of applied dry matter of from about 8 to 15, preferably 10 to 12, weight %. After the application of the bath, the textile material is squeezed, if required, on a squeezing device, for example a padder. The squeezing effect depends on the nature of the fiber and is generally in the range of from 75 to 100% in the case of pure cotton and of from 67 to 75% in the case of cotton/polyester blended fabrics (1:1). Subsequently, the textile material is dried at a temperature of from about 80° to 110° C. and thereafter exposed to a heat treatment, for example at 150° to 170° C. for a period of up to 3 minutes. Drying and heat treatment can alternatively be performed in one step at a temperature of about 150° C. Alternatively a heat treatment can be dispensed with, in this case the heat treatment required for the condensation of the resins is carried out only at that time when the textile material pretreated in the specified manner is printed under the action of heat according to the thermotransfer printing process.

The pretreated textile material is ready for printing and may be printed in known manner with the aid of a printed auxiliary carrier, for example paper, according to the thermotransfer printing process, the product of the formula I applied onto the cellulose in accordance with the invention acting as reactive swelling agents. They favor the dyestuff transfer and hence bring about a by far greater color depth. By the addition of the glyoxal or melamine formaldehyde resins a fast-to-washing fixation of these products onto the textile material is achieved and hence, the print, too, remains fast-to-washing. The above-described finishing imparts to the textile material a soft feel.

The following examples illustrate the invention:

EXAMPLE 1

A cotton fabric having a surface weight of 180 g/m$^2$ is dipped into an aqueous impregnation bath having the following composition:

120 g/l of a compound of the formula

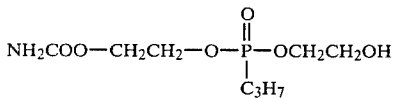

100 g/l of a 45% solution of dimethyloldihydroxyethylene urea, 70 g/l of polyethylene glycol (MW 400) and 12 g/l of magnesium chloride hexahydrate.

The fabric is squeezed on a padder to a liquor pick-up to 100%, dried subsequently at 100° C. and submitted to afterheating for 3 minutes at 150° C.

The pretreated fabric is thereafter contacted with a paper web printed with disperse dyes, for 45 seconds, at a temperature of 120° C. and under a pressure of 4 bars. Cooling gives a soft fabric printed with a good color depth. The print withstands several machine washings at 60° C. without suffering from a distinct fainting of the shades.

EXAMPLE 2

A polyester/cotton blended fabric (50:50) having a surface weight of 120 g/m$^2$ is pretreated in the manner specified in Example 1. The impregnation bath has the following composition 100 g/l of a compound of the formula

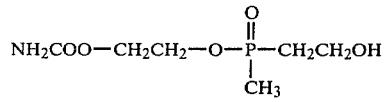

80 g/l of a 50% solution of hexamethylolmelamine pentamethyl ether and 10 g/l of magnesium chloride hexahydrate.

Printing according to the thermotransfer process gives likewise a brilliant print of good color depth. Inspite of the melamine resin portion the fabric remains very soft and the pattern remains unchanged even after several machine washings at 60° C.

EXAMPLE 3

A knitted fabric of 100% cotton (tricot) is impregnated in the manner described in Example 1 with a bath having the following composition:

150 g/l of a compound of the formula

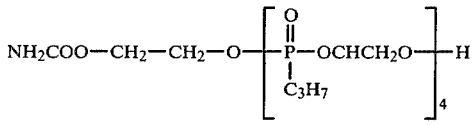

100 g/l of a 45% solution of dimethyloldihydroxiethylene urea and 12 g/l of ammonium chloride.

After having been printed according to the thermotransfer process the material pretreated in the above manner exhibits a finely-detailed pattern of good color depth, which is not reduced in strength even after several machine washings.

EXAMPLE 4

The fabric finished in the manner described in Example 2 is identical to that used in Example 2. The dipping bath contains 100 g/l of a compound of the formula

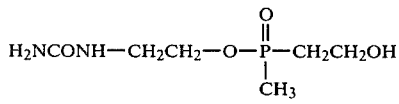

80 g/l of a 50% solution of hexamethylolmelamine pentamethyl ether and 10 g/l of magnesium chloride hexahydrate.

When using the bath of this composition, the effects reached are of the same quality as those achieved in Example 2.

EXAMPLE 5

A non-woven article having a surface weight of 70 g/m$^2$ and consisting of 80 weight parts of rayon staple and of 20 weight parts of polyester staple fibers is sprayed onto both faces with an aqueous solution of 300 weight parts of hydroxoethyl carbamate, 100 weight parts of a 75% solution of trimethylolmelamine dimethyl ether and 45 weight parts of ammonium chloride. This gives a quantity of dry matter applied of 30 weight %, calculated on the fibers. After spraying, the article is carefully dried at 100° C.

Next, the non-woven article is printed in the manner described in Example 1 with the aid of a paper web printed with disperse dyes, the melamine resin acting as a binding agent being simultaneously separated by condensation. A fast-to-washing print and non-woven fiber structure results.

What is claimed is:

1. A process for the pretreatment of textile material consisting entirely or partially of cellulose fibers and which is to be printed with disperse dyes according to the thermotransfer process, which comprises impregnating the textile material with a solution or dispersion containing (a) a compound of the formula I $$NH_2—CO—Y—R \quad (I)$$

wherein R stands for a group of the formulae $R_a$,$R_b$ or $R_c$ $$—CH_2—CH=CH_2 \quad (R_a)$$

$$—(CH_2—CH_2—O)_m—R_1 \quad (R_b)$$

or $$—CHR_3—CH_2—O—\left[\begin{array}{c} O \\ \| \\ P \\ | \\ R_2 \end{array}—X—CHR_3—CHR_3—O\right]_n—H \quad (R_c)$$

in said formulae $R_1$ is hydrogen or $C_{1-4}$alkyl, $R_2$ is $C_{1-4}$alkyl, $R_3$ is hydrogen or methyl, n is an integer of from 1 to 6, m is an integer of from 1 to 10, X is $CH_2$ or O and Y, in case that R stands for $R_a$ or $R_b$ is an oxygen atom and in case that R stands for $R_c$ is an oxygen atom or an imino group (NH), (b) a glyoxal or malamine formaldehyde resin and (c) an acid catalyst for the condensation of these resins, and subsequently drying the textile material and subjecting it to the action of heat.

2. The process as claimed in claim 1, wherein the solution or dispersion contains additionally a polyglycol of a molecular weight from 400 to 600.

* * * * *